US008188819B2

(12) United States Patent
Graf et al.

(10) Patent No.: US 8,188,819 B2
(45) Date of Patent: May 29, 2012

(54) SWITCHING DEVICE UNIT FOR SWITICHING AT LEAST TWO OPERATING STATES

(75) Inventors: Josef Graf, Hahnbach (DE); Ludwig Niebler, Laaber (DE); Norbert Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 295 days.

(21) Appl. No.: 12/311,113

(22) PCT Filed: Sep. 21, 2006

(86) PCT No.: PCT/EP2006/066576

§ 371 (c)(1),
(2), (4) Date: Mar. 19, 2009

(87) PCT Pub. No.: WO2008/034467

PCT Pub. Date: Mar. 27, 2008

(65) Prior Publication Data

US 2010/0085135 A1 Apr. 8, 2010

(51) Int. Cl.
*H01H 83/00* (2006.01)
*H01H 73/02* (2006.01)
*H01H 67/02* (2006.01)

(52) U.S. Cl. ..... 335/132; 335/21

(58) Field of Classification Search ..... 335/21, 335/132; 361/245, 102, 167
See application file for complete search history.

(56) References Cited

U.S. PATENT DOCUMENTS 2,025,292 A * 12/1935 Lockett ..... 68/140
4,021,704 A * 5/1977 Norbeck ..... 361/77
4,163,270 A * 7/1979 Marus ..... 361/77
4,345,225 A * 8/1982 Lemmer ..... 335/132
4,503,409 A * 3/1985 Lerude et al. ..... 335/132
4,644,308 A * 2/1987 Guery et al. ..... 335/128
4,647,838 A 3/1987 Chuang
4,803,587 A 2/1989 Fournier et al.
(Continued)

FOREIGN PATENT DOCUMENTS

AT 71472 A 1/1979
(Continued)

OTHER PUBLICATIONS

Michael Gieselmann; Niederspannungs-Schaltgeräte—Motorschutz wie aus dem Baukasten; Others; 1997; DE.

*Primary Examiner* — Elvin G Enad
*Assistant Examiner* — Alexander Talpalatskiy
(74) *Attorney, Agent, or Firm* — Harness, Dickey & Pierce, P.L.C.

(57) ABSTRACT

A switching device unit is disclosed for switching at least two operating states of at least one consumer to an at least two-phase electrical supply system by way of switching elements. At least one embodiment of the invention specifies a switching device unit which has as simple a construction as possible and is as cost-effective and compact as possible. For this purpose, the switching device unit contains circuits for operational switching of the consumer, for implementing the tripping function for protection against overload and short circuits, wherein these circuits are integrated in such a way that the switching device unit, in particular in terms of its function as a compact reversing starter, can have a standardized width in order to be installed in a space-saving manner on a top-hat rail in a switchgear cabinet and in order to be operated.

17 Claims, 4 Drawing Sheets

U.S. PATENT DOCUMENTS

| | | | | | |
|---|---|---|---|---|---|
| 4,994,725 | A | * | 2/1991 | Gschlossl | 318/727 |
| 5,099,385 | A | * | 3/1992 | Faffart | 361/245 |
| 5,483,212 | A | * | 1/1996 | Lankuttis et al. | 335/132 |
| 5,880,658 | A | * | 3/1999 | Donhauser et al. | 335/132 |
| 5,986,528 | A | * | 11/1999 | Meier et al. | 335/6 |
| 6,064,001 | A | * | 5/2000 | Ulerich et al. | 174/50 |
| 6,140,896 | A | * | 10/2000 | Heckenkamp | 335/159 |
| 6,150,909 | A | * | 11/2000 | Meier | 335/132 |
| 6,304,049 | B1 | * | 10/2001 | Fournier et al. | 318/520 |
| 6,441,328 | B1 | * | 8/2002 | Matejka et al. | 200/330 |
| 6,794,967 | B1 | * | 9/2004 | Park | 335/159 |
| 2002/0063615 | A1 | * | 5/2002 | Nomura et al. | 335/132 |
| 2004/0155619 | A1 | | 8/2004 | Hauselt et al. | |
| 2005/0135022 | A1 | * | 6/2005 | Kinzler et al. | 361/2 |

FOREIGN PATENT DOCUMENTS

| | | | |
|---|---|---|---|
| DE | 1036424 | | 8/1958 |
| DE | 3230562 | C2 | 12/1986 |
| DE | 3627672 | A1 | 2/1987 |
| EP | 0381542 | A1 | 8/1990 |
| EP | 1362405 | B1 | 4/2005 |
| FR | 2598027 | A1 | 10/1987 |
| WO | WO 03/043156 | A1 | 5/2003 |

* cited by examiner

SWITCHING DEVICE UNIT FOR SWITICHING AT LEAST TWO OPERATING STATES

PRIORITY STATEMENT

This application is the national phase under 35 U.S.C. §371 of PCT International Application No. PCT/EP2006/066576 which has an International filing date of Sep. 21, 2006, which designated the United States of America, the entire contents of each of which are hereby incorporated herein by reference.

FIELD

At least one embodiment of the invention generally relates to a switching device unit for switching at least two operating states of at least one consumer to an at least two-phase power supply network via switching elements.

BACKGROUND

Irrespective of its function, a switching device unit is generally also referred to as a consumer branch and is usually arranged next to further consumer branches on a standardized top-hat rail in a switchgear cabinet. The consumer branches that are arranged in a switchgear cabinet are assembled in a modular construction in order that the respective requirements can be met. Such consumer branches are used in particular in industrial plant engineering for controlling and switching high currents and voltages. In particular, a three-phase motor is driven using the switching device unit. In this case, the switching device unit is also referred to as a reversing starter or motor starter.

The switching device unit of one or more consumers usually has three functions for the protection of the consumer or consumers. The first function relates to the operational switching of the consumer, usually the motor, and is realized by means of a separate standard module, usually a so-called contactor. The contactor is designed for the purpose of repeatedly switching high currents on and off for operational use.

Furthermore, the functions for short-circuit protection and overload protection in a switching device can be integrated in a standard module which is referred to as a circuit breaker. The circuit breaker separates the consumer from the network if a short circuit occurs or if an excessive current is present. According to the prior art, the different functions are usually performed by different standard modules which are arranged next to each other on a chassis.

WO 03/043156 A1 discloses a control and protection module for a multipole low-voltage switching apparatus, which module consists of a mounting plate, a control electromagnet and a trip element, these being provided to act on mobile contacts for the purpose of opening or closing power terminals. In this case, the control and protection module uses the same number of switching elements or current trip elements as there are power terminals.

SUMMARY

At least one embodiment specifies a switching device unit which is as structurally simple, as economical and as compact as possible.

In at least one embodiment, a switching device unit is disclosed for switching at least two operating states of at least one consumer to an at least two-phase power supply network via switching elements, wherein the switching device unit features current paths for connecting to phases of the power supply network, the current paths can be assigned to an operating state and a switching element, the switching elements can be tripped by means of trip elements, and at least one trip element is provided for tripping a group of at least two switching elements, and the switching elements belonging to the group are provided for switching different operating states.

At least one embodiment of the invention is based on the insight that potential exists for simplifying existing switching devices. Various elements of the control and protection module should be integrated into one another to a greater degree. In this way, space-saving modules can be manufactured more simply and economically.

The functionality of the switching device unit is based on the consumer-dependent switching of operating states or the consumer-dependent switching of the phases by means of switching elements. The phases, which are also called poles, are carried on current paths and are switched to the consumer by virtue of a switching element mechanically producing an electrical contact for the relevant current path. Depending on which current paths are contacted, a specific operating state of the consumer is established. Therefore phases applied to a torque motor as a consumer can be switched to counterclockwise or clockwise, for example, in order to effect the necessary requirements for counterclockwise rotation or clockwise rotation of the torque motor. It is generally possible to achieve any connection of the consumer to the phases of the supply network.

The possibility for integrating the switching device unit with this functionality is based on the fact that there are current paths which are switched in a complementary manner to other current paths. In this way, it is possible to combine groups of current paths which can be assigned to an operating state and are complementary to other groups or other operating states. The switching device unit ensures that a group of current paths is not connected to the consumer at the same time as the complementary current path group. By virtue of the combination into groups, the switching mechanism is systematically simplified. This means that a current trip element does not just trigger one switching element as previously, for example, but that the invention provides for switching a plurality of current paths or current path groups simultaneously using a single current trip element.

The protection function is primarily guaranteed by way of the trip elements. The trip elements are e.g. current or short-circuit trip elements, or have both functions integrated. In order to reduce the number of trip elements, the switching elements that can be tripped by a trip element are connected to said trip element via a mechanical active connection. A physically close arrangement of the switching elements that can be tripped by the trip element is particularly advantageous, since the mechanical active connection is then easy to maintain, i.e. requires few components.

In an advantageous embodiment, it is advantageously possible to integrate or at least reduce the number of other apparatuses that are provided for short-circuit protection or power protection. One example of this type of apparatus is an overload trip element which protects against overload and/or short circuit as part of the electrical and/or thermal overload mechanism. The short-circuit protection function and power protection function are normally used at the output to the consumer. Since a plurality of functions are combined in the switching device unit, and now only one switching device unit remains, the number of protection mechanisms for short-circuit protection and power protection relates to the number of outputs of a device. By virtue of this design type, it is possible to construct e.g. a reversing starter circuit for a three-phase supply network comprising only three overload trip elements and three current analysis units instead of respectively six overload trip elements and six current analysis units (current transformers).

In an advantageous embodiment, at least two current paths can be assigned to a single switching element in each case. As a result of this, the number and hence the costs of the switching elements can be kept to a minimum.

A further advantageous embodiment features current paths which are assigned to the same or different operating states, said current paths being arranged next to each other, above each other or alternately. A greater degree of compactness is achieved thereby.

A further advantageous embodiment features switching elements, wherein the switching elements of the current paths which are assigned to the same or different operating states are arranged next to each other, above each other or alternately, whereby a greater degree of compactness is likewise achieved in addition to a structural simplification.

A further advantageous embodiment is provided for the short-circuit protection and/or overload protection functions, thereby avoiding further individual modules featuring one or both functions in the switchgear cabinet for reasons of space. The integration of the short-circuit protection and/or overload protection functions in the switchgear cabinet results in a multifunctional compact device unit.

A further advantageous embodiment is a switching device unit as a module for fastening to a top-hat rail, in order to ensure the compatibility with the conventional installation of switching devices in switchgear cabinets and also to keep the installation simple and efficient.

A further advantageous embodiment of the switching device unit is a compact device unit having a standard frame width, such that the space on the top-hat rail can be optimally utilized.

A further advantageous embodiment of the switching device unit is a motor starter, in particular a compact reversing starter, which switches the necessary operating states of the motor starter for operational use. In particular, provision is made for an operating state "motor clockwise rotation" and a further operating state "motor counterclockwise rotation".

A further advantageous embodiment features at least one consumer-side output which can be protected against overload and/or short circuit by an electrical and/or thermal overload trip function, whereby optimal protection is ensured at minimal structural cost.

A further advantageous embodiment features current paths which are at least partially integrated into a wiring of the switching device unit, wherein it is also possible to integrate the complete wiring, e.g. a reversing wiring, into the switching device unit.

The switching device unit advantageously features an electrical and/or mechanical lock to protect against incorrect use, said lock ideally being likewise integrated into the switching device unit. A user check or diagram is not required. For example, a reversing lock prevents an erroneous switching of a state which is not defined for a reversing starter.

Further advantageous configurations and preferred developments of the invention can be derived from the description of the figures and/or the subclaims.

BRIEF DESCRIPTION OF THE DRAWINGS

The invention is described and explained in greater detail below, with reference to the example embodiments illustrated in the figures, in which.

DETAILED DESCRIPTION OF THE EXAMPLE EMBODIMENTS

Figure 1:
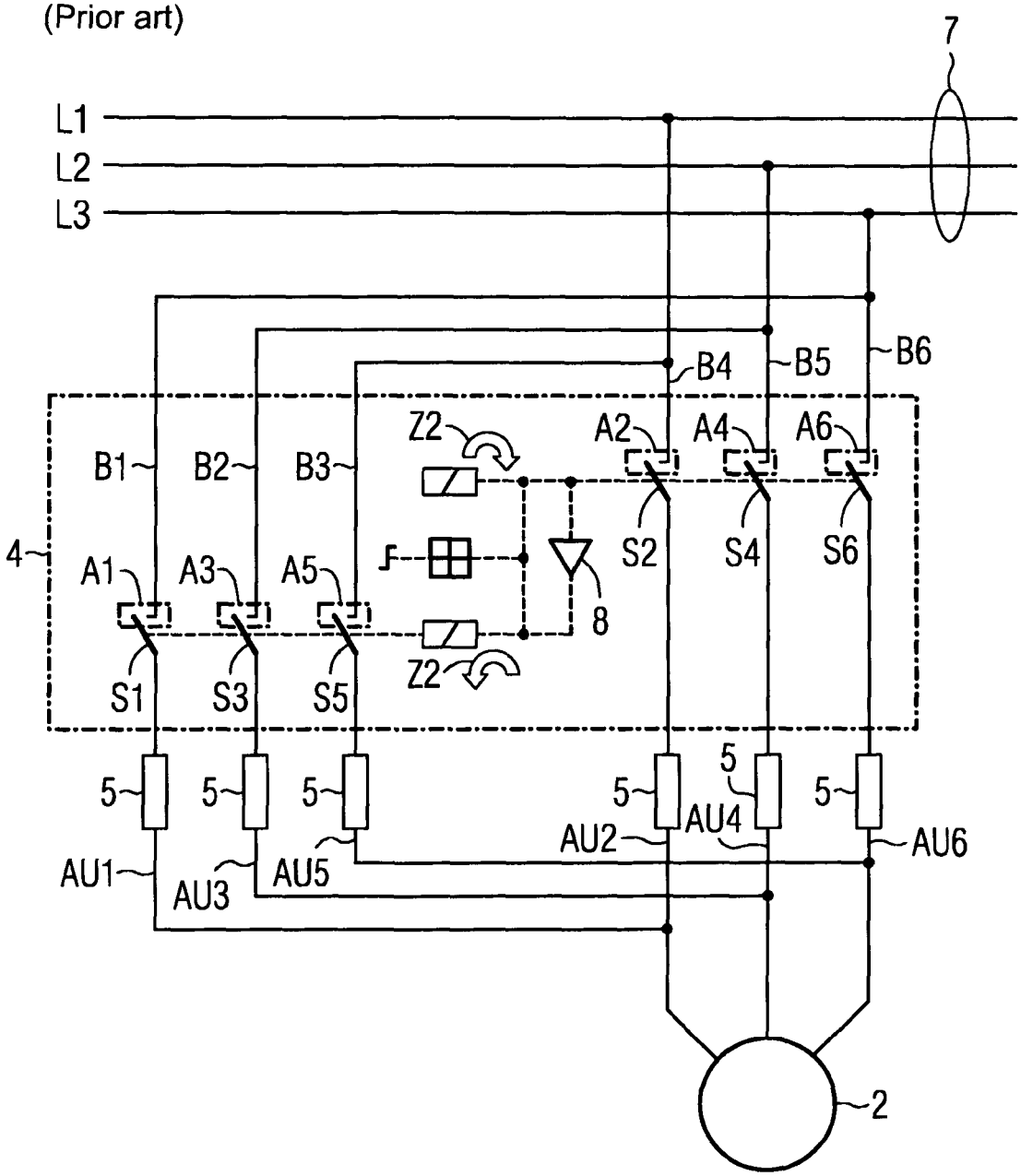
FIG 1 (Prior art)
FIG. 1 shows a circuit diagram of a reversing starter circuit which corresponds to the prior art.

FIG. 1 shows a circuit diagram of a reversing starter circuit 4 which corresponds to the prior art. The reversing starter circuit 4 is provided for a three-phase supply network 7 having the phases L1, L2 and L3. This reversing starter circuit 4 is usually embodied with two switching devices, each of which is capable of switching exactly one phase combination on and off and protecting said phase combination against short circuit and overload. Simply stated, the switching devices can activate or deactivate one operating state Z1, Z2 in each case. A mechanical safety device 8 is provided to prevent simultaneous activation of the two operating states Z1, Z2. The current paths B1, B2, B3, B4, B5, B6 within the switching devices are assigned to a switching element S1, S2, S3, S4, S5, S6 by means of a switching mechanism A1, A2, A3, A4, A5, A6.

The current trip elements 5 each serve one switching element S1, S2, S3, S4, S5, S6 and are actively connected to the relevant switching mechanism A1, A2, A3, A4, A5, A6 in order to effect positive opening of the relevant switching element S1, S2, S3, S4, S5, S6 in the event of protection tripping.

The consumer 2 represents a torque motor, wherein the first operating state Z1 corresponds to the clockwise rotation of the torque motor and the operating state Z2 respectively corresponds to the counterclockwise rotation of the torque motor. The motor standstill, which corresponds to non-operation of the torque motor, can be defined as a third operating state. This non-operation or third operating state can be selected using two switching devices, for example, in the same way as the two operating states Z1, Z2. For the sake of clarity, however, the non-operation is not considered as an operating state in the following. Operating state Z1 is activated when the switching elements S1, S3, S5 are tripped. When switching to the operating state Z2, the switching elements S1, S3, S5 are used again in order to deactivate the operating state Z1 first. Switching elements S2, S4 and S6 are then tripped in order to switch on the state Z2.

A reversing starter circuit is normally realized using two separate switching devices, wherein the switching elements S1, S3, S5 belong to one switching device and the switching elements S2, S4, S6 belong to the other switching device. The outputs AU1, AU2, AU3 are also assigned to the one switching device and the outputs AU4, AU5, AU6 are assigned to the other switching device and protected by means of a current trip element 5, e.g. an overload trip element 5. In the event of tripping due to overload, the relevant overload trip elements 5 act on the relevant switching element S1, S2, S3, S4, S5, S6 to the effect that the currently active operating state Z1, Z2 is switched off.

Conventional reversing starters, which include an integrated circuit breaker protection function and are based on the reversing starter circuit 4 or a similar circuit, are made of at least two switching devices according to the existing prior art, said switching devices being assembled using connection parts such as cables, for example. In this case, the switching devices are usually implemented in a structural width of 45 mm with a reversing block being mounted "underneath" or in a structural width of 98 mm with a reversing function being mounted "to the side", wherein this exceeds the actual frame dimension of the individual devices of 2*45 mm=90 mm.

In the case of reversing starters having internal current trip elements with a striker armature function according to the existing prior art, it is disadvantageous that a current trip element or striker armature is required at each switching position, giving a total of 6 units per reversing starter, whereby additional manufacturing and assembly costs are incurred. In this case, the switching current of the reversing starter is e.g. 32 A, but can also exceed this value.

The functions of the switching devices were previously carried out by a plurality of device units, such that the outputs of these device units always had to be protected separately.

Figure 2:
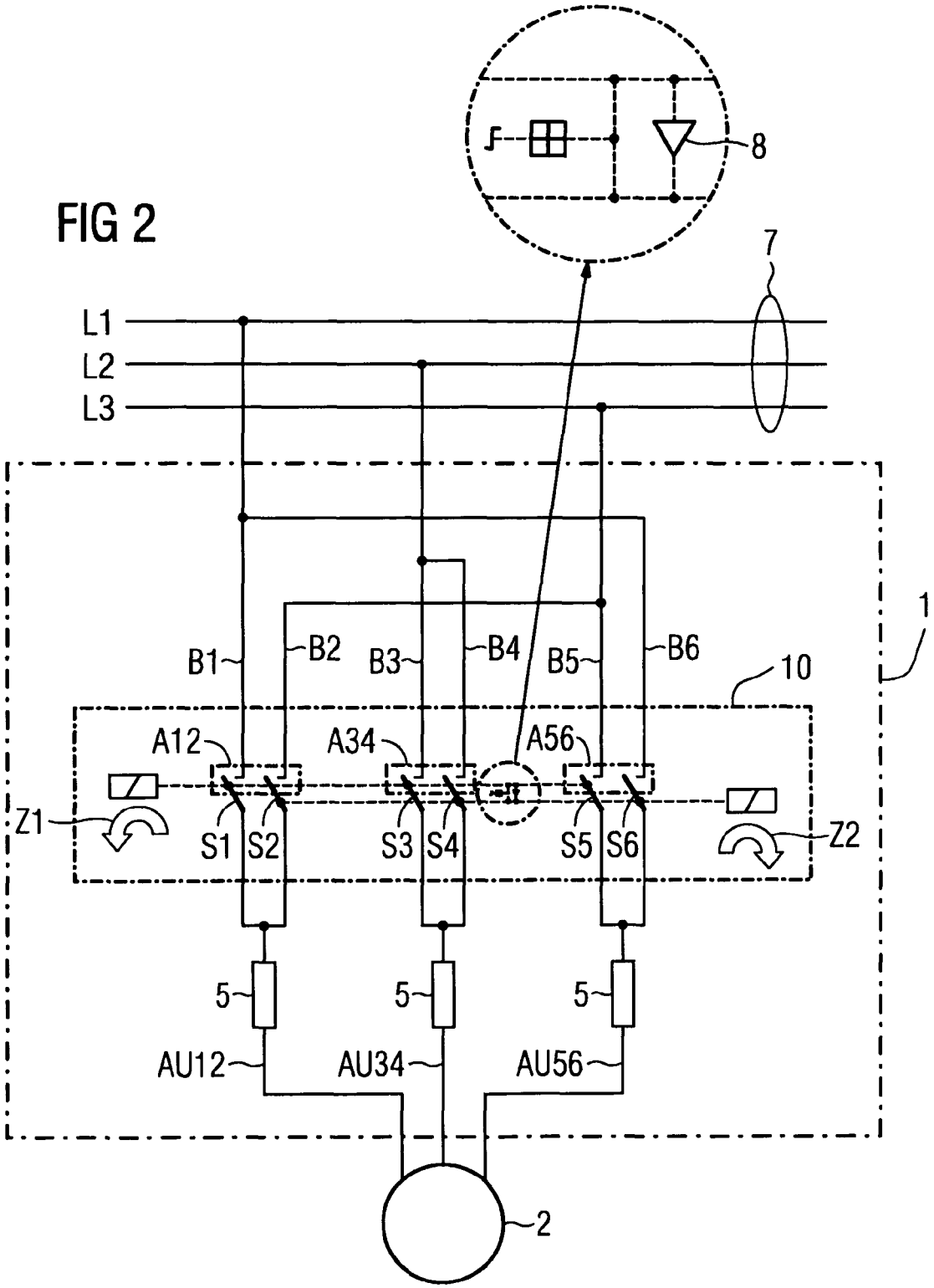
FIG. 2 shows a circuit diagram of a compact circuit of a switching device unit.

FIG. 2 shows a circuit diagram of a compact circuit 1 of a switching device unit. The functionality is similar to the example embodiment described in FIG. 1, but the construction is significantly different. In the compact circuit 1 of the switching device unit, only three current trip elements 5 are required instead of six current trip elements 5 as in the example embodiment in FIG. 1. This is possible because complementary current paths B1, B2; B3, B4; B5, B6 are combined in pairs, wherein one current path B1, B3, B5 is assigned to the operating state Z1 and the complementary current path B2, B4, B6 is assigned to the operating state Z2. In this example embodiment, the current path B1 is complementary to B2, the current path B3 is complementary to B4 and the current path B5 is complementary to B6. A switching mechanism A12 therefore simultaneously effects the deactivation of B2 when activating B1, and a switching mechanism A34 effects the simultaneous activation of B3 and deactivation of B4, etc. In this context, the switching mechanisms A12, A34, A56 can be two independently functioning mechanisms in each case, or advantageously at least partially integrated mechanisms. The switching mechanisms A12, A34, A56 can be embodied e.g. as two switch bridges comprising one mobile contact each, or as one switch bridge comprising two mobile contacts.

After this operation, the switching device unit is in the operating state Z1. This operation functions correspondingly in reverse in order to switch back to the operating state Z2 again.

The number of overload trip elements 5 has likewise been reduced by half in comparison with the example embodiment in FIG. 1. This is possible because only the outputs AU12, AU34, AU56 of the switching device or switching device unit need to be protected. By virtue of the paired arrangement of the current paths B1, B2; B3, B4; B5, B6 for the operating state Z1 (subsequently referred to as counterclockwise rotation) and the operating state Z2 (subsequently referred to as clockwise rotation) directly next to each other, the six current paths B1, B2; B3, B4; B5, B6 of the compact circuit 1 can be operated using the three current trip elements 5. In this case, the current flow is internally selected such that the current is routed via the current trip elements 5 and then branched into the current paths B1, B2; B3, B4; B5, B6 for the counterclockwise or clockwise rotation respectively.

Figure 4:
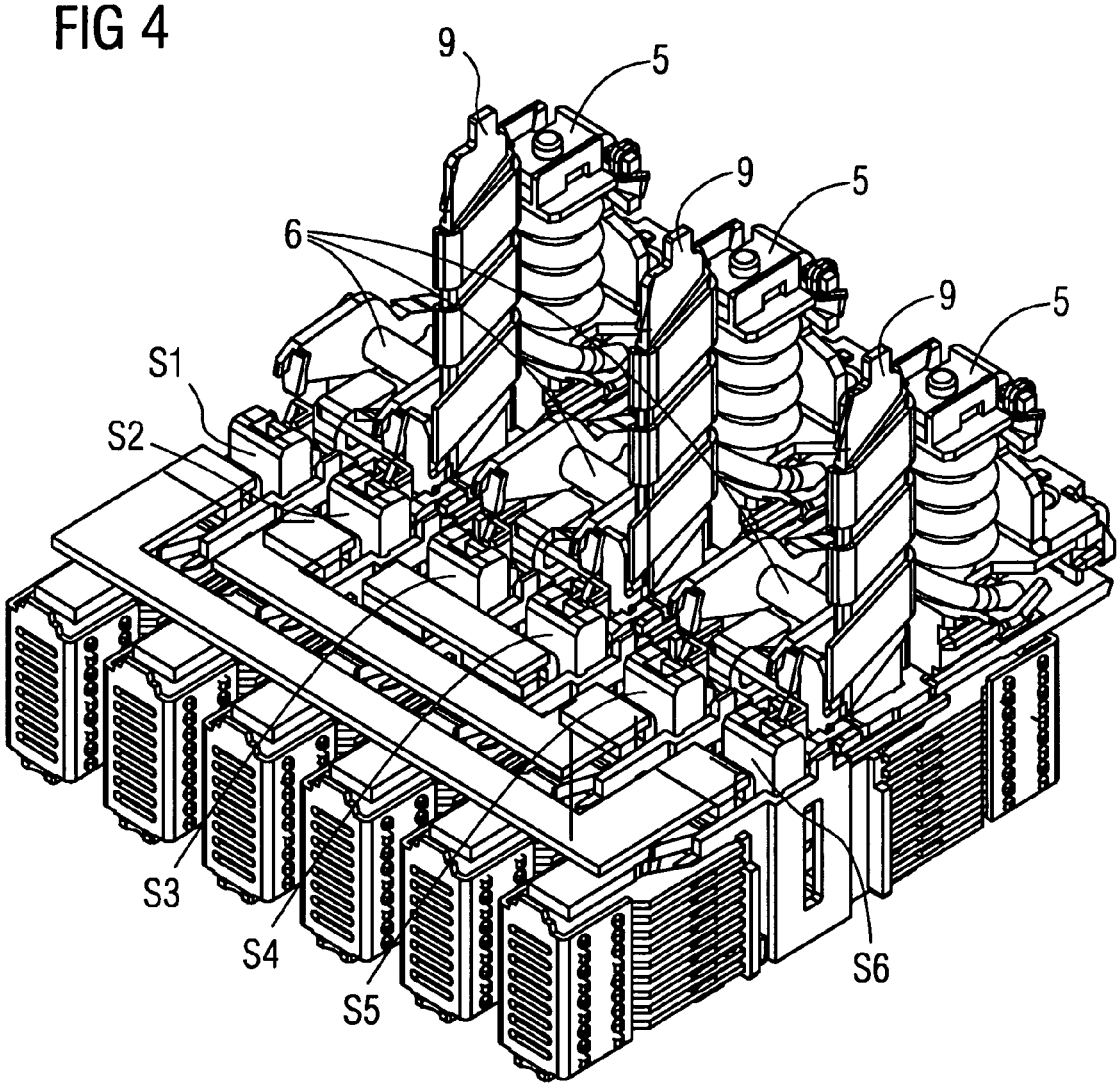
FIG. 4 shows a three-dimensional view of a further example embodiment of a switching device unit having one current path level.

In this case, the current trip elements 5 are assigned to associated current paths B1, B2; B3, B4; B5, B6 and can open two switching elements S1, S2; S3, S4; S5, S6 simultaneously by way of a mechanical active connection, as shown in FIG. 4 by way of example. Specifically, this means that the switching element pairs S1/S2, S3/S4 and S5/S6 can be tripped in each case by the current trip elements 5. By virtue of this design type, it is possible for a reversing starter circuit 10 of the switching device unit to be equipped with only three current trip elements 5, and for a structural width of only 90 mm to be realized for the switching device unit containing the reversing starter circuit 10.

Figure 3:
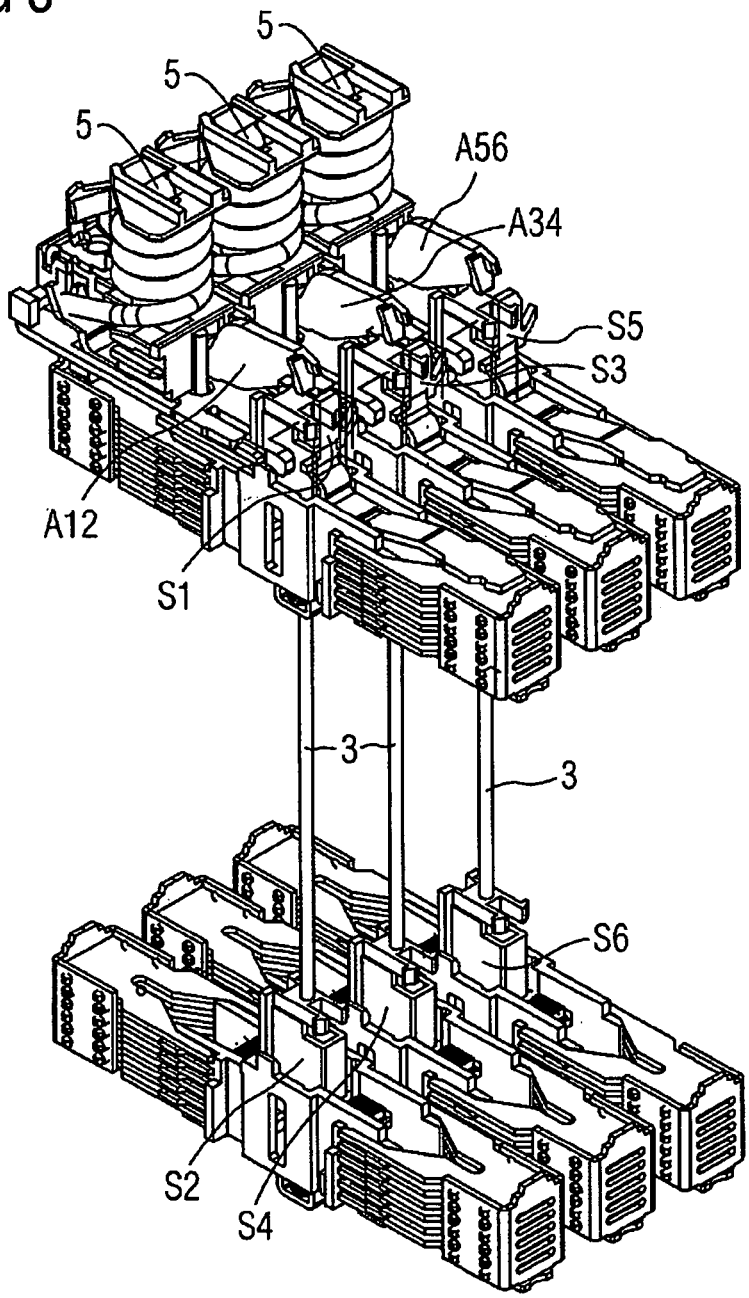
FIG. 3 shows a three-dimensional view of an example embodiment of a switching device unit having two current path levels.

FIG. 3 shows a three-dimensional view of an example embodiment of the switching device unit comprising two current path levels for use as a compact reversing starter. In terms of a circuit, the structure is the same as the structure described in the example embodiment in FIG. 2. The compact reversing starter houses the current paths B1, B2; B3, B4; B5, B6 of an operating state Z1, Z2 in one level, thereby resulting in two current path groups lying one above the other.

In this example embodiment, as described in the example embodiment in FIG. 2, six switching elements S1, S2, S3, S4, S5, S6 are required, wherein only three overload trip elements 5 are necessary for their protection. Since the compact reversing starter is designed for two three-pole or three-phase operating states Z1, Z2, the switching elements S1, S3, S5 are initially coupled to the overload trip elements 5 by means of switching mechanisms A12, A34, A56. Furthermore, active connections are transferred from the switching elements S1, S3, S5 respectively to the switching elements S2, S4, S6 in the lower level by means of plungers 3, which likewise function as mechanical couplings. Three overload trip elements 5 are held in the upper level and act on the upper and lower switching elements S1, S2, S3, S4, S5, S6 by means of the switching mechanisms A12, A34, A56 and the plungers 3, wherein the plungers 3 can also be part of the switching mechanisms A12, A34, A56. The switching mechanisms A12, A34, A56 are not integrated in the switching mechanism of the switching element S1, S2, S3, S4, S5, S6 for this purpose, but primarily have a coupling function here.

FIG. 4 shows a three-dimensional view of a further example embodiment of the switching device unit comprising one current path level for example use as a compact reversing starter having the same circuit structure as disclosed in FIG. 2. The current paths B1, B2; B3, B4; B5, B6 are routed in a single level. The coupling of an overload trip element 5 to two switching elements S1, S2; S3, S4; S5, S6 is realized via a rocker 6. The coupling is likewise of a mechanical nature in this example embodiment, and can be used by a thermal trip element 9 in the same way to trip the positive opening as part of a dual protection function.

By virtue of the example embodiments in FIGS. 3 and 4, or combinations of the same, it is possible to realize compact reversing starter modules which satisfy the space requirements in a switchgear cabinet.

In summary, at least one embodiment of the invention relates to a switching device unit for switching at least two operating states of at least one consumer to an at least two-phase power supply network by means of switching elements. At least one embodiment of the invention addresses the problem of specifying a switching device unit which is as structurally simple, as economical and as compact as possible. To this end, the switching device unit contains circuits for operational switching of the consumer, for executing the tripping function to protect against overload and short circuit, wherein these circuits are integrated in such a way that the switching device unit, in particular having the function of a compact reversing starter, can feature a standardized width in order to be installed in a space-saving manner and operated on a top-hat rail in a switchgear cabinet.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A switching device unit for switching at least two operating states of at least one consumer to an at least two-phase power supply network via a plurality of paired switching elements, comprising:

current paths for connecting to phases of the at least two-phase power supply network, the current paths being assignable to an operating state of the at least two operating states;

a plurality of switching mechanisms each comprising a pair of switching elements, the current paths being assignable to a pair of switching elements of the plurality of switching mechanisms; and a trip element connected to a respective switching mechanism for tripping a pair of switching elements of the respective switching mechanism, the pair of switching elements belonging to the group being provided for switching different operating states, wherein each of the switching mechanisms is assigned to a single respective tripping element for tripping a respective pair of switching elements assigned to a corresponding tripping element.

2. The switching device unit as claimed in claim 1, wherein the at least one trip element is at least one of a current trip element and a short-circuit trip element.

3. The switching device unit as claimed in claim 1, wherein at least two current paths are each assignable to a single one of the plurality of paired switching elements.

4. The switching device unit as claimed in claim 1, wherein the current paths which are assigned to the same or different operating states are arranged next to each other, above each other or alternately.

5. The switching device unit as claimed in claim 1, wherein the switching elements of the current paths which are assigned to the same or different operating states are arranged next to each other, above each other or alternately.

6. The switching device unit as claimed in claim 1, wherein the switching device unit is provided for at least one of the short-circuit protection and overload protection functions.

7. The switching device unit as claimed in claim 1, wherein the switching device unit is designed as a compact device unit having a standard frame width.

8. The switching device unit as claimed in claim 1, wherein the switching device unit is designed as a motor starter.

9. The switching device unit as claimed in claim 1, wherein the switching device unit is designed for an operating state "motor clockwise rotation" and a further operating state "motor counterclockwise rotation".

10. The switching device unit as claimed in claim 1, wherein at least one consumer-side output of the switching device unit is protectable against at least one of overload and short circuit by at least one of an electrical and thermal overload trip function of the at least one trip element.

11. The switching device unit as claimed in claim 1, wherein the current paths are at least partially integrated into the switching device unit.

12. The switching device unit as claimed in claim 1, wherein at least one of an electrical and mechanical lock, to protect against incorrect use, is integrated into the switching device unit.

13. The switching device unit as claimed in claim 2, wherein the short-circuit trip element is an electromagnetic short-circuit trip element.

14. The switching device unit as claimed in claim 2, wherein at least two current paths are each assignable to a single one of the at least two switching elements.

15. The switching device unit as claimed in claim 4, wherein the switching elements of the current paths which are assigned to the same or different operating states are arranged next to each other, above each other or alternately.

16. The switching device unit as claimed in claim 8, wherein the switching device unit is designed as a compact reversing starter.

17. The switching device unit as claimed in claim 1, wherein complementary current paths are arranged in pairs, one of the current paths being assigned to a first operating state and a second current path being assigned to a second operating state.

* * * * *